US009051104B2

(12) United States Patent
Heirman et al.

(10) Patent No.: US 9,051,104 B2
(45) Date of Patent: Jun. 9, 2015

(54) COMPOSITE CONTAINERS

(75) Inventors: Marc Heirman, Kortrijk (BE); Daniël Achiel Camiel Wardenier, Hooglede (BE)

(73) Assignee: Cargill, Incorporated, Wayzata, MN (US)

( * ) Notice: Subject to any disclaimer, the term of this patent is extended or adjusted under 35 U.S.C. 154(b) by 399 days.

(21) Appl. No.: 13/498,409

(22) PCT Filed: Sep. 24, 2010

(86) PCT No.: PCT/EP2010/005844

§ 371 (c)(1), (2), (4) Date: Mar. 27, 2012

(87) PCT Pub. No.: WO2011/035917

PCT Pub. Date: Mar. 31, 2011

(65) Prior Publication Data

US 2012/0193356 A1 Aug. 2, 2012

(30) Foreign Application Priority Data

Sep. 28, 2009 (EP) ..... 09012261

(51) Int. Cl.

| | |
|---|---|
| ***B65D 77/04*** | (2006.01) |
| *B65D 1/02* | (2006.01) |
| *B65D 5/50* | (2006.01) |

(52) U.S. Cl.

CPC ..... *B65D 77/0426* (2013.01); *B65D 1/0223* (2013.01); *B65D 5/50* (2013.01); *B65D 2501/0081* (2013.01)

(58) Field of Classification Search

CPC .... B65D 77/0426; B65D 1/0223; B65D 5/50; B65D 2501/0081

USPC ..... 220/23.87, 23.83, 23.86, 23.9, 23.91, 220/592.15, 592.23; 206/503, 504, 821

See application file for complete search history.

(56) References Cited

U.S. PATENT DOCUMENTS 3,179,323 A * 4/1965 Miller ..... 220/23.87
3,819,036 A 6/1974 Weldon (Continued)

FOREIGN PATENT DOCUMENTS

JP 2001/097448 A 4/2001
WO 2011/035917 A1 3/2011

OTHER PUBLICATIONS

PCT International Search Report PCT/EP2010/005844. Mailed Dec. 12, 2010. 2 Pages.

*Primary Examiner* — Robert J Hicks
*Assistant Examiner* — Kareen Rush

(57) ABSTRACT

A composite container (10) comprising a rectangular cuboidal rigid outer-container (20) comprising a top and a bottom surface (21,22) connected by four side walls (23), and a single compressible, rigid inner-container (30) for containing a pourable product, said inner-container having a basis weight of from 150 g/m$^2$ to 700 g/m$^2$, and said inner container comprising a top (31), a bottom (32), and a closable opening (33) located at said top. The inner-container (30) comprises at least one zone (34) having a circular cross-section and at least two zones (35) having a non-circular cross-section, whereby said at least two zones (35) having a non-circular cross-section are in contact with the inner surface of said outer-container (20). The at least two zones (35) having a non-circular cross-section are separated by said at least one zone (34) having a circular cross-section.

15 Claims, 2 Drawing Sheets

(56) References Cited

U.S. PATENT DOCUMENTS

| | | | | | |
|---|---|---|---|---|---|
| 3,946,654 | A | * | 3/1976 | Janssen | |
| 4,173,288 | A | * | 11/1979 | Schutz | 220/1.5 |
| 4,909,387 | A | * | 3/1990 | Schutz | 206/386 |
| 5,176,294 | A | | 1/1993 | Della Riva | |
| 5,183,175 | A | * | 2/1993 | Brown | 220/23.87 |
| 5,642,833 | A | | 7/1997 | Ring | |
| 6,045,036 | A | | 4/2000 | Ring | |
| 6,286,700 | B1 | | 9/2001 | Davidson | |
| 8,376,170 | B1 | * | 2/2013 | Lobdell | 220/212 |
| 2002/0066735 | A1 | | 6/2002 | Hewlitt et al. | |
| 2009/0134171 | A1 | * | 5/2009 | deBerardinis | 220/562 |

* cited by examiner

COMPOSITE CONTAINERS

CROSS-REFERENCE TO RELATED APPLICATIONS

This application claims benefit of international application PCT/EP2010/005844, filed Sep. 24, 2010, which application claims priority to European Application 09012261.5, filed Sep. 28, 2009, which applications are hereby incorporated by reference herein in their entirety.

FIELD OF THE INVENTION

The present invention relates to novel composite containers. In particular, the present invention relates to novel bottle-in-box types containers.

BACKGROUND OF THE INVENTION

The term "composite container" (or "composite packaging") is generally used to refer to packaging made up of an inner-container and an outer-container, assembled into a single unit. These containers are most commonly used for the transport and storage of liquids.

The outer-container is typically produced from fibreboard and is used to ensure easy stacking, and to provide the protection (e.g. from light) and strength that may be lacking from the inner-container.

There are two main categories of inner-container: bag-type containers and jug-type containers.

The bag-type containers are produced from thin, supple materials. They are light, can be stored flat before use and can easily be compressed after use. However, their lack of rigidity is also a drawback: they have a tendency to bulge (requiring thicker and therefore more expensive outer-containers), are more likely to split and leak during use (especially along the seal which joins the two sides of the bag together) and require the use of complex supportive spout systems for decanting.

Jug-type containers are much more robust, being produced from thick, rigid plastic materials, for example high density polyethylene. However this also means they are much heavier, more expensive, slower to make and harder to dispose of after use (since they cannot easily be compressed).

As such, there is a clear need for an alternative that provides both the rigidity of jug-in-box type containers and compactibility of their bag-in-box counterparts, while having a lower overall weight. The present invention provides such an alternative.

SUMMARY OF THE INVENTION

According to one aspect of the present invention, there is provided a composite container comprising a. a rectangular cuboidal rigid outer-container comprising a top and a bottom surface connected by 4 side walls, and
b. a single compressible, rigid inner-container for containing a pourable product, said inner-container having a basis weight of from 150 g/m$^2$ to 700 g/m$^2$, and said inner container comprising a top, a bottom, and a closeable opening located at said top, said inner-container comprising at least one zone having a circular cross-section and at least 2 zones having a non-circular cross-section, and said at least 2 zones having a non-circular cross-section being in contact with the inner surface of said outer-container, characterised in that said at least 2 zones having a non-circular cross-section are separated by said at least one zone having a circular cross-section.

According to a second aspect of the present invention, there is provided a process for producing a composite container according to the present invention comprising the steps of:

a. providing a preform for a compressible, rigid inner-container
b. blow-molding the preform
c. recovering the finished, inner-container
d. assembling the inner-container within a rigid outer-container
e. filling the inner container with a pourable product
f. optionally, pressurizing the inner-container with gas
g. sealing the inner container
h. closing said outer-container.

According to a third aspect of the present invention, there is provided a process for the manufacture of a composite container comprising:

a. providing a preform for a compressible, rigid inner-container
b. blow-molding the preform
c. recovering the finished, inner-container
d. filling the inner container with a pourable product
e. optionally, pressurizing the inner-container with gas
f. assembling the inner-container within a rigid outer-container
g. sealing the inner container
h. closing said outer-container.

DETAILED DESCRIPTION OF THE INVENTION

Figure 1:
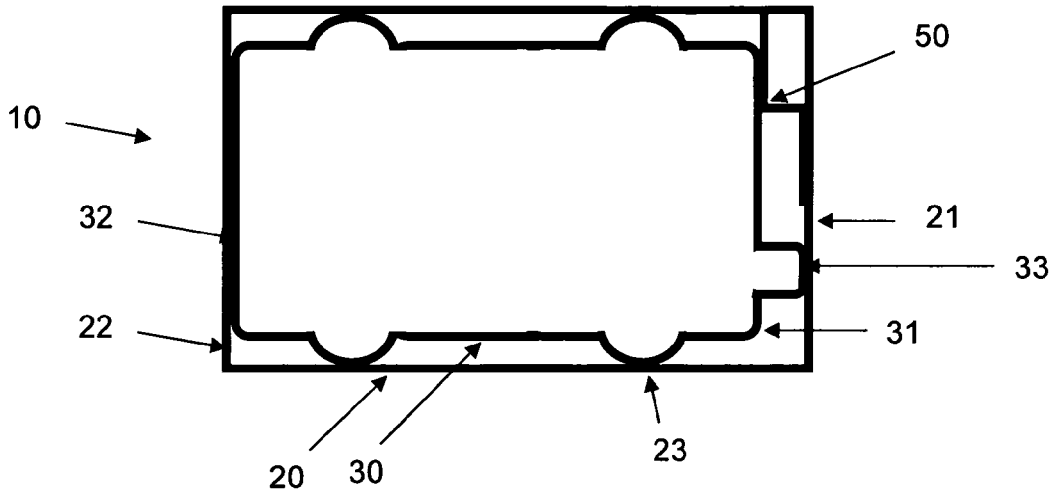
FIG. 1 shows a cross-section of the composite container according to the present invention.

FIG. 1 shows a composite container 10 according to the present invention comprising a rigid outer-container 20, and a single compressible, rigid inner-container 30.

The term "rigid" as used herein refers to any assembly or structure, the shape of which can be maintained even under a certain amount of pressure (e.g. during stacking). The exact level of rigidity required will of course depend upon the container's particular end use. Thus, for example, when used for storing small quantities of liquid, the outer-container will not need to be as strong or rigid as compared to larger volumes.

As shown in FIG. 1, the outer-container 20 has a rectangular cuboidal shape, and comprises a top surface 21, a bottom surface 22 connected by 4 side walls 23 (wherein "sides" is used here to refer to the lateral surfaces of the container).

The inner-container 30 of the present invention is rigid, yet compressible and is used for containing a pourable product. The term "compressible" as used herein refers to the fact that the containers may be compressed or compacted (i.e. their volume may be reduced) without the use of excessive force, by applying just a moderate amount of pressure (e.g. manual pressure or under the weight of a human body). What's more, their volume will preferably remain substantially reduced even after that pressure has been removed. Nonetheless, the inner-containers will still be capable of being self-supporting. Thus, unlike bag-type containers, they will be capable of maintaining their shape (i.e. they will not collapse) under normal atmospheric pressure and will not be substantially deformed when filled with and/or emptied of their contents nor when they are pressurised with the pressures mentioned herein below.

The inner-container 30 according to the present invention has a basis weight of from 150 g/m$^2$ to 700 g/m$^2$. Preferably, the basis weight ranges from 200 g/m$^2$ to 600 g/m$^2$, even more preferably from 250 g/m$^2$ to 550 g/m$^2$, even more preferably from 250 g/m$^2$ to 500 g/m$^2$.

In one preferred embodiment, the inner-container is made from a gas-tight material. The term "gas-tight material" as used herein refers to any material which has a low gas permeability. More specifically, it refers to a material which, when used in accordance with the present invention, is capable of maintaining an internal overpressure of at least 0.003 MPa for the entire shelf-life of its intended contents. The length of the shelf-life will of course depend on the nature of the contents. In any event, the inner-container should be capable of maintaining an internal overpressure of at least 3000 Pa for at least 30 days, preferably at least 60 days, even more preferably at least 12 months.

The gas-tight material may be selected from single-layer materials, composites, coated materials and laminates, with or without additives.

Preferably, the inner-containers of the invention will be produced from polyethylene terephthalate (PET), PET copolymers (such as polyethylene terephthalate glycol (PETG)), polyethylene naphthalate (PEN), poly-acrylonitrile (PAN), poly-lactic acid polymers (PLA) or blends, composites or laminates thereof. Most preferably, the inner-container will be produced from PET. When more than one layer is used (e.g. for laminates or coated products), the individual layers preferably includes at least one material that reduces gas permeability. Examples of such materials, in addition to those already listed above, are oriented nylon, silicon, copolyester barrier materials and phenoxy-type thermoplastic materials.

Figure 2:
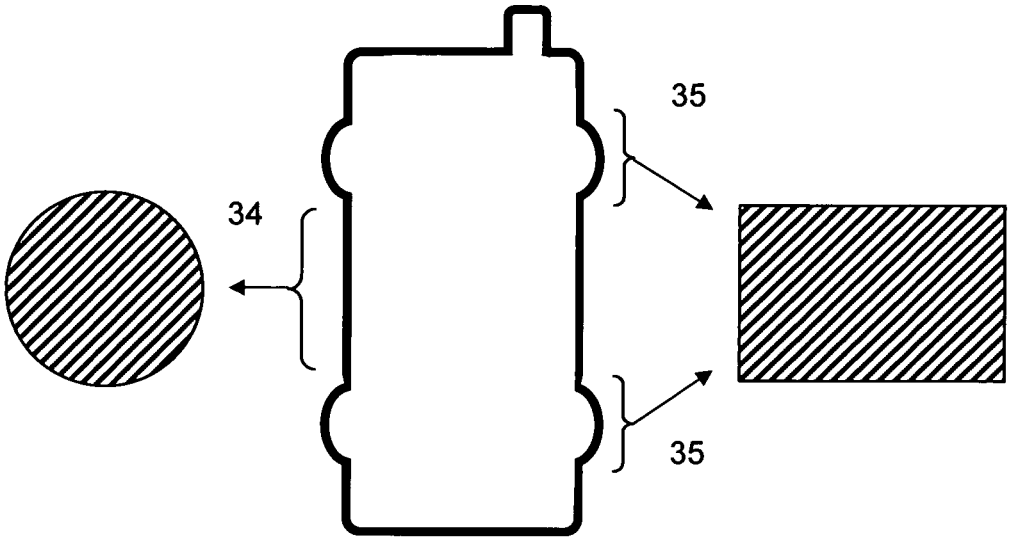
FIG. 2 shows cross-sections of an inner-container according to the present invention.

As shown in FIG. 2, the inner-container 30 comprises a top 31, a bottom 32, and a closable opening 33 located at said top 31. The inner-container 30 comprises at least one zone 34 having a circular cross-section and at least 2 zones 35 having a non-circular cross-section. The at least 2 zones 35 having a non-circular cross-section are separated by said at least one zone 34 having a circular cross-section.

The term "circular cross-section" is meant to include not only a cross-section with a perfect circular shape, but also with a general circular shape or an ellipsoidal shape.

The term "non-circular cross-section" is meant to include any cross-section having a shape different from circular, as defined herein above. This may include rectangular or square cross-sections, with sharp corners or rounded corners. This may also include any shape which defines a rectangular or square when connecting all the end-points of the cross-section of said zone.

Said cross-sections are to be taken perpendicular to the longitudinal axis between the top and the bottom of said inner-container.

The dimensions of the non-circular cross-section are such that the at least 2 zones having a non-circular cross-section are in contact with the inner surface of said outer-container. Preferably said at least 2 zones having a non-circular cross-section are in contact with at least 2 side walls, even more preferably with at least 2 opposite side walls, and even more preferably with all 4 side walls of said outer-container.

As such, the inner-container tightly fits within the outer-container and provides additional support to the outer-container and improves the overall strength of the composite container. Another advantage is that the inner-container is not able to move perpendicular to the longitudinal axis between the top and bottom of said inner-container, which facilitates the handling of the composite container, especially when larger volumes are used.

The at least one zone having a circular cross-section ensures that the inner-container withstands bulging upon filling or because of gas pressure variations throughout storage or transport.

The at least two zones having a non-circular cross-section create additional volume (compared to cylindrical containers), and since they are in contact with the inner-surface of the outer-container, they further provide additional support to the outer-container and additional strength overall to the composite container.

In one embodiment, the dimensions of the non-circular cross-section are larger than the dimensions of the circular cross-section. In another, preferred, embodiment the dimensions of the circular cross-section are such that also the at least one zone with the circular cross-section is in contact with the inner surface of the outer-container. Not only does this further improve the support of the outer-container by the inner-container, it also creates additional volume that can be used.

The number of zones with a non-circular cross-section can vary, and can be increased depending on the dimensions of the inner-container. But preferably, said at least 2 zones with a non-circular cross-section are located towards or nearby the bottom and the top of said inner-container. Further zones with a non-rectangular cross-section may be added in-between. Adjacent zones with a non-circular cross-section are preferably separated by a zone with a circular cross-section.

In one highly preferred embodiment, the inner-container comprises alternating zones having a non-circular cross-section with zones having a circular cross-section. Preferably, in such an alternating mode, the zones nearby or adjacent the top and the bottom of the inner-container are zones having a non-circular cross-section. Even more preferably, in such an alternating mode, both zones of circular and non-circular cross-section are in contact with the inner surface of the outer-container.

The composite container according to the present invention is supposed to be used as is. This means that the inner-container does not have to be removed from the outer-container prior to use.

Preferred embodiments of the composite container according to the present invention, will now be further explained.

The outer-container may be produced from coated or uncoated paperboard, single-faced or double-faced corrugated board or laminates (including, for instance, paper/aluminium laminates and paper/plastic laminates).

The container may include printed or printable surfaces. Preferably, it will be produced from materials which provide its contents with protection from light. Preferably, the outer-container may comprise one or more openings and/or handles to improve the handling of the composite container. Alternatively, or additionally, the inner-container may comprise one or more handles which may extend through an opening in the outer-container.

The materials used to produce the outer-container will preferably have a thickness, defined in terms of basis weight, in the range of from 150 g/m$^2$ to 1200 g/m$^2$, preferably from 200 g/m$^2$ to 1100 g/m$^2$, even more preferably from 300 g/m$^2$ to 800 g/m$^2$.

In a preferred embodiment, the weight ratio of the outer-container to the inner container is from 2 to 6, more preferably from 2 to 5, even more preferably from 2 to 4 and most preferably from 2 to 3. Interestingly, it has been found that for identical outer-containers, a much lighter inner-container can be used when compared for example to jug-in-box counterparts, the latter typically having a weight ratio of 1 to 1.75. In some executions, the present invention even allows to use inner-containers having an equivalent of, or an even lower weight than the bags used in bag-in-box containers.

Also interestingly, it has been found that outer-containers produced for use in accordance with the present invention can be lighter than their bag-in-box and jug-in-box counterparts.

As such, the composite container according to the present invention not only overcomes the negatives of the bag-in-box and jug-in-box containers in terms of weight, storage and use, but further leads to significant material saving and production efficiency (with thinner containers being blown more quickly and easily) and therefore cost savings.

In another preferred embodiment, the weight of the composite container per volume of the inner-container is from 20 g/L to 55 g/L.

In order to further increase its rigidity as well as the rigidity of the composite container as a whole, the inner-container of the present invention can be placed, in use, under an internal overpressure of between 3000 Pa and 50000 Pa, preferably of between 5000 Pa and 50000 Pa. The gas used to pressurise the inner-container will depend on its particular end use, but is preferably selected from the group consisting of nitrogen and carbon dioxide. For carbonated beverages, for instance, $CO_2$ will be preferred whereas for oils, nitrogen will be preferred.

Additional measures for increasing the rigidity and/or strength of the inner-container may also be used. According to one preferred embodiment, the bottom of the inner-container may be inwardly bulged. Especially when the inner-container is pressurised, said inwardly bulged bottom will ensure that the inner-container keeps it shape and thus prevent the inner-container from outward bulging. In a preferred embodiment, said inwardly bulged bottom is designed such that it also serves as a grip.

Certain parts of the inner-container (the bottom, for instance) may also be reinforced by allowing for a slightly greater material thickness. What's more, the material used to produce the inner-container will preferably have a crystallinity of less than 20%, more preferably of less than 10%, most preferably of less than 5%. The crystallinity of a material is the percentage of its volume which is in crystalline, instead of amorphous, form.

While the inner-container according to the present invention is not limited to a particular volume, the biggest advantages are observed for inner-containers having a volume from 5 liter to 50 liter, preferably from 7.5 liter to 40 liter, even more preferably from 10 liter to 25 liter.

The opening is preferably a spout, and may be shaped or positioned as desired. Preferably, the spout will be positioned asymmetrically to facilitate pouring and to reduce product waste. Also preferably, the spout is not extending beyond the dimensions of the outer-container, and even more preferably said spout is protected from the external environment by said outer-container prior to use. The latter can be achieved for example by a removable portion in the outer-container, which can be removed prior to use. This prevents the inner-container's contents from light-exposure, dust or dirt and thereby enhances the hygienic aspect of the composite container according to the present invention.

The composite container of the present invention may be used for transport and/or storage of pourable goods, more preferably for fluids and liquids and most preferably for water, oil, or oil-based products. In one particularly preferred embodiment, the pourable product is an oil or an oil-based product, and the gas to pressurise the inner-container is nitrogen.

The composite container may further comprise a support element 50, as shown in FIG. 1. Said support element provides additional strength to the composite container, while also preventing the inner-container from sliding within said outer-container. Said support element is preferably located adjacent the spout, so as to give extra strength in the region next to the spout and to prevent the outer-container from collapsing.

The inner- and outer-containers are preferably separable. The term "separable" as used herein means that the outer-container and the inner-container may be manually detached or separated from one another (unlike, for instance, laminated packaging where the various layers cannot easily be dissociated). Thus, although the composite container of the invention is intended to be used as a single unit, the inner-container and outer-container may be manufactured and/or disposed of independently. The outer-container will preferably be easy to reduce in volume, either by simple disassembly (i.e. unfolding) or by compaction/crushing.

The composite container of the present invention may be assembled using any method known in the art. Typically, it will be produced by a process including the following steps:

- providing a rigid outer-container and a compressible, rigid inner-container (as defined above);
- assembling the inner-container within the outer-container;
- filling the inner-container;
- sealing the inner-container, wherein the inner-container may optionally be pressurised with gas before it is sealed closing said outer-container According to a preferred embodiment, the compressible inner-container will be produced by blow-molding. Blow-molding is a well known technique in the art. It typically involves providing a preform made from the desired thermoplastic material (in this case, for example, PET), placing the preform in a mold and then pumping air into the preform such that it stretches out to match the mold. Various blow-molding techniques can be used including extrusion blow-molding, injection blow-molding and stretch blow-molding. Stretch blow-molding is particularly preferred.

The preform for the inner-container may be blown either before or after assembly within the outer-container. Preferably, however, it will be blown before assembly. Thus, according to one embodiment of the present invention, there is provided a process for the manufacture of composite containers comprising:

- providing a preform for the inner-container;
- blow-molding the preform;
- recovering the finished inner-container;
- assembling the inner-container within a rigid outer-container (as defined above);
- filling the inner-container;
- optionally, pressurising the inner container;
- sealing the inner-container; and
- closing said outer-container.

All of these steps can be performed in-line, one after the other, e.g. in an automated process, with connected blowing, boxing, filling, gas-dosing and capping machines. Alternatively the assembly of the composite container itself and the filling, optional pressurisation and sealing can occur separately. Thus, the manufacturer of the composite container and the producer of the container's contents do not need to be located together.

The sealing step can be performed using any known method, including foil sealing, cap closure (e.g. screw cap or hinged lid) or, indeed, a combination of both. However it is performed, the sealing step must ensure that the inner-container remains gas-tight.

What is claimed is:

1. A composite container comprising:

a. a rectangular cuboidal semi rigid outer-container comprising a top and a bottom surface connected by four side walls; and b. a single compressible, rigid inner-container for containing a pourable product, said inner-container having a basis weight of from 150 g/m$^2$ to 700 g/m$^2$, and said inner container comprising a top, a bottom, and a closeable opening located at said top, wherein said inner-container comprises at least one zone having a circular cross-section and at least two zones having a non-circular cross-section, and wherein said at least two zones having a non-circular cross-section are in contact with the inner surface of said outer-container, and wherein said at least two zones having a non-circular cross-section are separated by said at least one zone having a circular cross-section.

2. The composite container of claim 1, wherein said at least one zone having a circular cross-section is in contact with the inner-surface of said outer-container.

3. The composite container of claim 1, wherein said outer-container has a basis weight of from 150 g/m$^2$ to 1200 g/m$^2$.

4. The composite container of claim 1, wherein the ratio of the weight of the outer-container to the weight of the inner container is from 2 to 6.

5. The composite container of claim 1, wherein the weight of said composite container per volume of said inner-container is from 20 g/L to 55 g/L.

6. The composite container of claim 1, wherein said inner-container is filled with gas to an overpressure of from 3000 Pa to 50000 Pa.

7. The composite container of claim 6, wherein said gas is selected from the group consisting of nitrogen and carbon dioxide.

8. The composite container of claim 1, wherein said opening is a spout, said spout is not extending beyond the dimensions of said outer container.

9. The composite container of claim 8, wherein said spout is asymmetrically positioned.

10. The composite container of claim 8, wherein said spout is protected from the external environment by said outer-container prior to use.

11. The composite container of claim 1, wherein said inner-container and said outer-container are separable and easy to reduce in volume.

12. The composite container of claim 1, wherein said composite container further comprises a support element, said support element preventing said inner-container from sliding within said outer-container.

13. The composite container of claim 1, wherein said pourable product is fluid.

14. A process fir producing the composite container of claim 1, the process comprising:

a. providing a pre-form for a compressible, semi rigid inner-container;

b. blow-molding the pre-form;

c. recovering the finished, inner-container;

d. assembling the inner-container within a rigid outer-container;

e. filling the inner container;

f. pressurizing the inner-container;

g. sealing the inner container; and h. closing said outer-container.

15. A process for producing the composite container of claim 1, the process comprising:

a. providing a perform for a compressible, semi rigid inner-container;

b. blow-molding the pre-form;

c. recovering the finished, inner-container;

d. filling the inner container;

e. pressurizing the inner-container;

f. assembling the inner-container within a rigid outer-container;

g. sealing the inner container; and h. closing said outer-container.

* * * * *